US005156891A

United States Patent [19]

Isoe et al.

[11] Patent Number: 5,156,891

[45] Date of Patent: Oct. 20, 1992

[54] RESIN-IMPREGNATED STRENGTHENED POCKET BOTTOMS

[75] Inventors: Mark R. Isoe, Northbrook, Ill.; Franz Duy, Dallas, Tex.

[73] Assignee: OST Industries, Inc., Chicago, Ill.

[21] Appl. No.: 833,078

[22] Filed: Feb. 10, 1992

Related U.S. Application Data

[60] Division of Ser. No. 496,246, Mar. 20, 1990, Pat. No. 5,124,190, which is a division of Ser. No. 911,912, Sep. 24, 1986, Pat. No. 4,910,069, which is a continuation-in-part of Ser. No. 815,208, Dec. 31, 1985, abandoned.

[51] Int. Cl.[5] ..... B05D 3/12

[52] U.S. Cl. ..... 427/289; 2/248; 427/389.9; 427/401

[58] Field of Search ..... 2/247, 248; 427/289, 427/389.9, 401; 428/173, 224, 266

[56] References Cited

U.S. PATENT DOCUMENTS

| | | | |
|---|---|---|---|
| 2,295,425 | 9/1942 | Potter | 2/247 |
| 2,436,879 | 3/1948 | Buck | 2/248 |
| 3,163,867 | 1/1965 | Halcomb | 2/248 |
| 3,725,960 | 4/1973 | Hall | 2/248 |
| 3,930,090 | 12/1975 | Campbell et al. | 428/225 |
| 4,910,069 | 3/1990 | Isoe et al. | 428/173 |

*Primary Examiner*—Michael Lusignan
*Attorney, Agent, or Firm*—Eugene F. Friedman

[57] ABSTRACT

Resin-coated bottoms of pockets to provide extended life for the porous material. Coating one side of the pocket bottoms provides enhanced abrasion resistance and reduces seam slippage along the stitching on the pocket's bottom. The resin may include a polyurethane or a polyacrylate, with a polyester polyurethane combination finding particular utility. The resin fills many of the pores of material, but leaves others open. The open pores avoids perspiration and other moisture from adhering to the wearer's skin. Coloring the resin helps identify the resin's presence as well as providing an indication of origin for the garment or pocket itself. Typically, the only manufacturing of the pocket includes coating one side of the pocketing material with the uncured resin. The compound embedded on one side of the material then undergoes curing, generally through the application of heat, to form a coherent substance and open the pores.

6 Claims, 1 Drawing Sheet

RESIN-IMPREGNATED STRENGTHENED POCKET BOTTOMS

This is a division of application Ser. No. 7/496,246, filed Mar. 20, 1990, now U.S. Pat. No. 5,124,190, which is a division of U.S. application Ser. No. 6/911,912, filed Sep. 24, 1986, now U.S. Pat. No. 4,910,069, issued on Mar. 20, 1990, which was a continuation-in-part of U.S. application Ser. No. 815,208, filed Dec. 31, 1985, now abandoned.

BACKGROUND

As most people indubitably know, the pockets on garments have a propensity of wearing out. This problem becomes especially disturbing to men who, in almost all instances, have no purses in which to carry their belongings. Thus, holes in their pockets often portend the loss of valued item, such as coins and keys.

A pocket generally develops holes in two fashions. First, the material at the seam may undergo slippage and come apart. In other words, the material may not have the strength to avoid the loss of integrity required at the sewing line to stay together. Alternately, of course, a hole may simply wear through the material itself.

Clearly, to minimize the development of holes in pockets, garment manufacturers can use a heavier material for the pockets. However, that may result in the pocket having unacceptable bulk which could destroy the line of the garment. Moreover, it substantially increases the cost and concomitantly the price of the garment itself. Additionally, a heavier material may not avoid the seam slippage at the sewing line where many holes develop in actual wear.

Alternately, the manufacturer may use a process called "double tipping" or "double bagging". This involves sewing an extra layer of material to the pocket's bottom. This process suffers from many of the defects seen for the heavier material. Further, it incurs the increased expense of an added step in the manufacturing process.

Manufacturers have also woven the pocketing material with a heavier fabric in the area of the pocket's bottom. This specialized technique increases the fabric's cost. Further, it may not even appreciably help avoid seam slippage.

W. J. Potter, in his U.S. Pat. No. 2,295,425, coats the inside of pocket bottoms with a rubber bottom to extend the pockets' lives. However, the solid rubber coating prevents the passage moisture which results in the wearer's skin moisture in the area acquiring a clammy or wet feel. The rubber also has an unacceptable and thick feel.

To ameliorate the problems encountered with Potter's pockets, U.S. Pat. No. 3,725,960, to R. H. Hall impregnates the fibres of pocketing material with a resin while leaving the spaces between the fibres entirely free of the polymer. However, putting the resin on both sides of material gives it an unacceptable feel and stiffness.

Clearly, a pocket that would have increased wear constitutes a desirable feature in the garment industry. However, it should have a pleasing feel and pliability but not substantially increase the cost of the garment itself. Furthermore, the material used should have very little affect, if any, upon the garment's line. Additionally, the avoidance of both seam slippage and wearing through the material represent important facets of any pocketing material used.

SUMMARY

To provide an improved, wear resistant pocket, a moisture permeable polymer resin should coat one side of the portion of the porous material forming the pocket's bottom. This will increase the resistance of the pocket to developing holes through the material and also help avoid seam slippage of the material where sewn.

Coating one side only of the pocketing material avoids endowing the pocket with an undesirable stiffness. Further, it leaves the other side with a pleasant, cloth-like feel.

The pocketing material naturally displays porosity. The resin should leave unfilled at least some of the pores of the material. This will help prevent seam slippage as well as holes wearing through. Yet, the other pores in the material will help avoid any dampness building up on the wearer's skin.

Typically, a garment includes a shell material having a top oriented towards the direction of the wearer's head. A pocket, attached to the inside of the shell and forming part of the garment, includes a web of porous material with two portions of its edge attached together to form the enclosure. The remaining portion of the edge remains unattached to form an opening into the pocket. The bottom of the pocket lies in the direction oriented away from the top of the garment's shell.

Manufacturing the reinforced pocket involves first coating with a resin one side of at least a portion of a web of porous fabric large enough to form at least one pocket. Typically, the web has several sections, with each possessing sufficient size to create a pocket. Economically, the resin only coats strips of the material which will, in subsequent manufacture, form the bottoms of the pocket. This avoids the expensive additional resin where not needed for reinforcement. Further, coating only the pocket's bottom allows the remainder of the pocket to exhibit its original porosity and, accordingly, to "breathe" more facilely than the coated area. Further, limiting the area of coating to that actually suffering deleterious wear reduces the cost of manufacturing without sacrificing quality.

After the coating operation, the manufacturer cuts the web into at least one section of material having a size and shape to form a pocket. He then sews the section of material into the shape of a pocket having a top and a bottom. The bottom should include the portion with the polymer resin.

Typically, the manufacturer will treat a roll of pocketing material having a width equal to at least several pockets. The coating will occur in strips. Usually, in this case, most of the strips will have a location that will cover the bottoms of two lines of pockets lying on adjacent sides of the coating strips.

Upon the completion of manufacture, the material finding use for pockets takes the form of a web of porous fabric having a sufficient size to contain a plurality of sections. Each section, in turn, permits the formation of at least one pocket for an item of clothing. To provide the reinforcement, a polymer resin coats at least a portion of each of the sections which will subsequently form a pocket.

DETAILED DESCRIPTION

Figure 1:
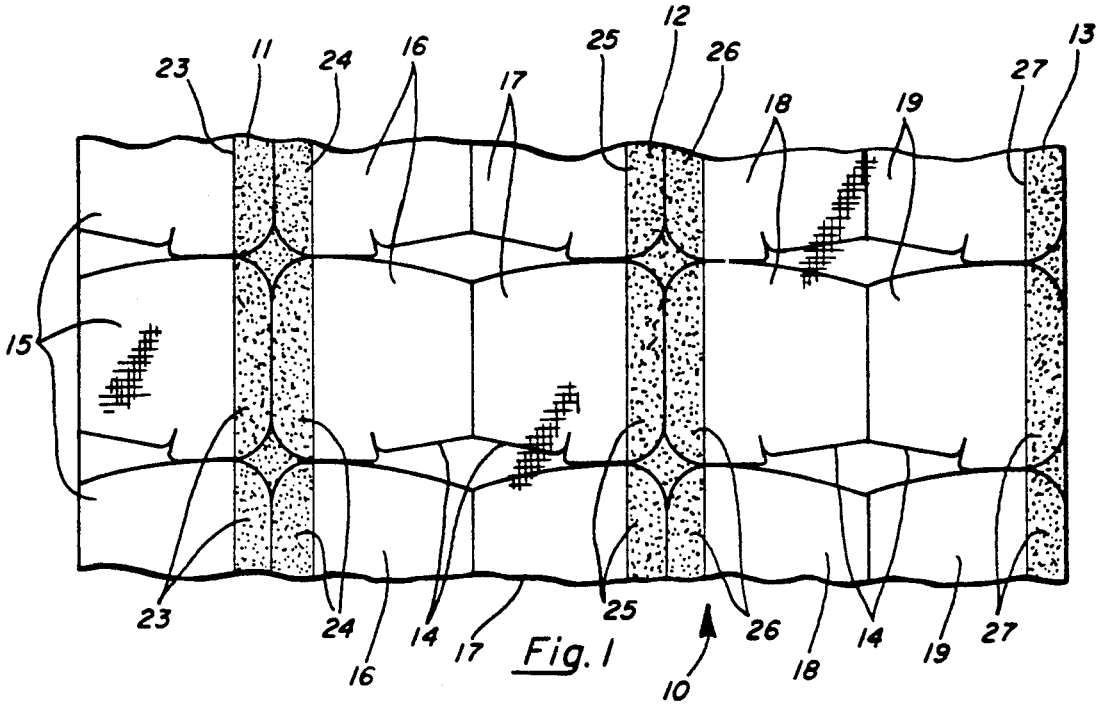
FIG. 1 shows an expanse of material having strips coated with a resin and marked cutting lines for forming pockets.

FIG. 1 shows a broad swath of pocketing cloth generally at having the strips 11 to 13 coated with a polymer resin. The material 10 includes the line markings 14 which serve to delineate the various sections of material 15 to 19 that will form pockets. Cutting the material on the lines 14 will, in fact, form sections of material such as the segment 15 in FIG. 2, for example, used in making a pocket.

As seen in FIG. 1, the resin coated strip 11 includes the bottoms 23 of the pockets 15, as well as the bottoms 24 of the pockets 16. Similarly, the resin coated strip 12 includes materials for the bottoms 25 and 26 of the pocket sections 17 and 18, respectively. Lastly, the resin coated strip 13 lies along the side of the swath of material and thus includes only the bottoms 27 of the single row of pockets 19.

Figure 2:
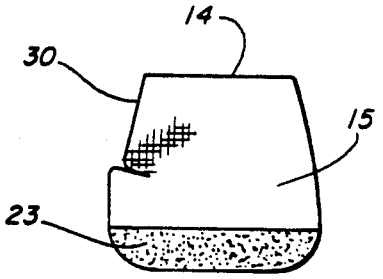
FIG. 2 gives one section of cloth cut from the expanse of material of FIG. 1 and having a coated bottom.

Producing the pocket involves cutting out along the line 14 one of the pocket sections 15 from the swath of cloth 10 to give the form shown in FIG. 2. As seen there, the section 15 includes the slight cutout along the edge 30 which permits the wearer of the garment to actually place his hand in the pocket when formed.

Figure 3:
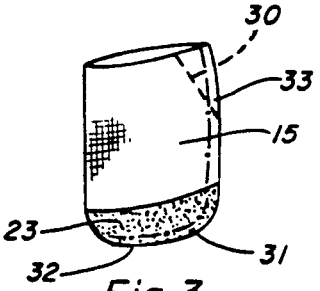
FIG. 3 shows a pocket formed from the section of material seen in FIG. 2.

The manufacturing of a pocket next involves folding the section 15 of FIG. 2 in half to create the form of an 20 envelope as shown in FIG. 3. There the stitching 31 has proceeded in the usual fashion along the bottom edge 32 and the side edge 33, which may include stitching, turning, and top stitching. However, the stitching has missed the edge portion 30 to allow an opening for the wearer to place his hand into the pocket.

Figure 4:
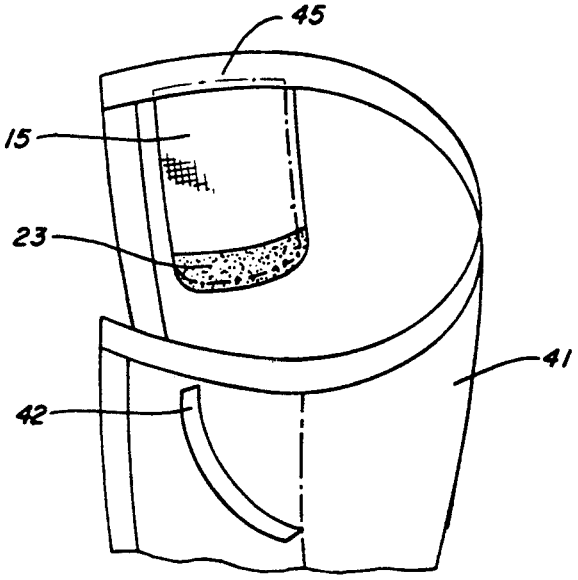
FIG. 4 depicts a garment having the pocket of FIG. 3 attached.

FIG. 4 shows the garment 41 having the opening 42 on the left side and another opening, not seen in FIG. 4, on the other side of the pants. The openings permit the passage of the wearer's hand through the shell fabric of the garment 41 in order to enter the pockets. In particular, the passage of the hand through the opening on the right side of the pants permits entry into the pocket 15 attached to the garment 41 by the stitching 43. In the final garment, the polymer coated section 23 remains at the bottom of the pocket 15.

The manufacture of the swath of material 10 with the strips 11 to 13 of resin coating starts with a plain strip of pocketing material, generally arranged on a roll. The material is attached to a pin tenter frame prior to further treatment. The pin tenter frame keeps the width of the material the same as it receives the resin and undergoes curing. The cloth is pinned on both sides to the frame which keeps the material from necking down, or becoming narrower, during these operations.

The material then runs between a knife-over-roller mechanism. The roller, of course, sits on one side while the knife scrapes the material on the other side. The polymer resin sits beneath the knife on top of the material. The knife scrapes the material and forces the polymer resin into one side of the material. It also serves to control the amount of resin adhering to the cloth's surface. At this point, the uncured resin completely covers the pores of the material.

Alternately, the uncured resin may find use in the form of a film. In this instance, the manufacturer may place the film of resin in contact with the fabric to create a laminate. In the laminate, the resin again fills the pores. Passing the coated fabric through heat rollers will serve to both embed the resin into one side of the material and cause the resin to undergo curing. The heat curing causes the resin to shrink and open at least some of the pores.

Either method of application will serve to apply the resin to one side only of the material. Further, both will also result in the resin initially filling in the pores.

The resin embedded within one side of the material then undergoes curing to set it permanently in the fabric and reopen at least some of the filled pores. For the typical thermoset resin, this involves placing it in an oven. In the particular case of polyurethane, the oven should typically have a temperature of at least 350° F., and the cloth should remain in it for at least two minutes. When the cloth moves through an oven with a length of 35 feet, it should not move faster then about 15 feet per minute.

The polymer resin should have a composition that will preclude it from leaching out from the material in its normal use and cleaning. Thus, the resin should not dissolve in or react with the solvents or chemicals used in washing or cleaning. Further, it should not melt at the usual washing or dry cleaning temperatures. This requirement, of course, does not pose a serious limitation to thermoset resins which, of course, actually polymerize in heat. For a thermal resin, the melting point should remain sufficiently high to preclude its becoming liquefied at the usually encountered temperatures.

The resin should also shrink when cured. This reopens some of the pores which will allow dampness appearing on the wearer's skin to pass through and evaporate.

The resin itself may take the form of a polyurethane, an acrylic, or a silicone, with the first of these representing the preferred compound. Specifically, the polyester polyurethane compound sold under the trademark "Solucote 153" by the Soluol Chemical Company of West Warwick, R.I., has proven effective in use.

Additionally, the resin may include a coloring which, first, can assure the manufacturer that the pocket bottoms include the resin. Furthermore, the coloring can also serve as an indication of origin of the manufacturer of the pocketing or the garment itself.

The pocket with the impregnated resin coating will avoid deleterious wear in two fashions. First, the material itself will have greater strength against holes abrading through due to the presence of heavy and irregular objects such as keys, coins, and the like. Second, the material will have greater strength to hold the stitching; thus, the pocket show less propensity to separate at the seam creating a hold right at the pocket's bottom.

Accordingly, what is claimed is:

1. A method for forming a strengthened pocket for a garment comprising:

A. coating one side only, of at least a portion of a web of porous fabric large enough to form a pocket with an uncured polymer resin so that the resin covers the pores of said portions of said fabric;

B. heating said resin until at least some of the covered pores becomes open;

C. cutting from said web of fabric a section of material having the size and shape to form a pocket with said portion including at least the bottom of said pocket;

D. sewing said section of said web of fabric into the shape of a pocket having a top and a bottom, with said coated portion at least at said bottom of said pocket.

2. The method of claim 1 wherein the step of coating said web is accomplished by contacting said web with uncured resin and then curing said resin.

3. The method of claim 2 wherein said web is coated in strips with said resin.

4. The method of claim 3 wherein said resin is an actylic, a polyurethane, or a silicone.

5. The method of claim 4 wherein said resin is a polyester polyurethane.

6. The method of claim 4 wherein said resin is colored.

* * * * *

UNITED STATES PATENT AND TRADEMARK OFFICE

CERTIFICATE OF CORRECTION

PATENT NO. : 5,156,891

DATED : October 20, 1992

INVENTOR(S) : Mark R. Isoe and Franz Duy

It is certified that error appears in the above-identified patent and that said Letters Patent is hereby corrected as shown below:

On the title page, item (73):
Assignee, change "OST" to --QST--.

Signed and Sealed this

Ninth Day of November, 1993

Bruce Lehman

*Attest:*

BRUCE LEHMAN

*Attesting Officer*

*Commissioner of Patents and Trademarks*